US007984961B2

(12) United States Patent
Sakurai

(10) Patent No.: US 7,984,961 B2
(45) Date of Patent: Jul. 26, 2011

(54) INK-JET TYPE IMAGE RECORDING APPARATUS AND PURGE MECHANISM

(75) Inventor: Hisaki Sakurai, Aichi-ken (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 1115 days.

(21) Appl. No.: 11/789,405

(22) Filed: Apr. 24, 2007

(65) Prior Publication Data

US 2007/0252865 A1 Nov. 1, 2007

(30) Foreign Application Priority Data

Apr. 26, 2006 (JP) ..... 2006-121542

(51) Int. Cl.
*B41J 2/165* (2006.01)

(52) U.S. Cl. ..... 347/29; 347/30

(58) Field of Classification Search ..... 347/29–30
See application file for complete search history.

(56) References Cited

U.S. PATENT DOCUMENTS 5,426,456 A * 6/1995 Kuelzer et al. ..... 347/30
6,471,330 B1 * 10/2002 Umeda et al. ..... 347/29
6,527,361 B1 * 3/2003 Gotoh et al. ..... 347/30
6,623,098 B2 * 9/2003 Davis ..... 347/29
7,377,616 B2 * 5/2008 Sakurai ..... 347/29
7,661,805 B2 * 2/2010 Usui ..... 347/92
7,695,095 B2 * 4/2010 Shindo ..... 347/29
2005/0253909 A1 * 11/2005 Usui ..... 347/92

FOREIGN PATENT DOCUMENTS

JP 9-187954 7/1997
JP 2002-254664 9/2002

* cited by examiner

*Primary Examiner* — Julian D Huffman
*Assistant Examiner* — Jason S Uhlenhake
(74) *Attorney, Agent, or Firm* — Frommer Lawrence & Haug LLP

(57) ABSTRACT

An ink-jet type image recording apparatus includes a recording head which has a nozzle surface having a plurality of nozzles formed therein; a suction mechanism which generates a suction force, a first cap having a first lip portion, and a second cap having a second lip section. Since the second lip portion has a stiffness higher than that of the first lip portion, it is possible to provide an ink-jet type image recording apparatus including a second cap capable of preventing a deformation due to a negative pressure generated inside the second cap, and a first cap capable of maintaining a moisture-retained state of a nozzle group with a less load exerted on the recording head.

22 Claims, 8 Drawing Sheets

INK-JET TYPE IMAGE RECORDING APPARATUS AND PURGE MECHANISM

CROSS-REFERENCE TO RELATED APPLICATION

The present application claims priority from Japanese Patent Application No. 2006-121542, filed on Apr. 26, 2006, the disclosure of which is incorporated herein by reference in its entirety.

BACKGROUND OF THE INVENTION

1. Field of the Invention

The present invention relates to an ink-jet type image recording apparatus which includes a recording head having a nozzle surface in which a plurality of nozzle groups is formed, and which performs recording by jetting an ink onto a recording medium, a suction cap which covers the nozzle groups and through which the ink is sucked from the nozzle groups, and a preserving cap which covers the nozzle groups to preserve the ink when the recording head is not used. The present invention also relates to a purge mechanism which purges the recording head.

2. Description of the Related Art

An ink-jet type image recording apparatus jets an ink toward a recording medium such as a plain paper. Characters and images expressed in dots are recorded by adhering droplets of the ink jetted onto a surface of the recording medium. The droplets of ink are jetted at a high speed toward the recording medium from a nozzle group including a plurality of fine nozzles provided in a nozzle surface of a recording head. When there is a clog in the nozzle due to hardening (drying) of the ink and/or adhering of dust, or when there is an air bubble in the nozzle, it leads to defects such as a decline in an accuracy of landing of the ink droplets, and/or unevenness in an amount of ink which is jetted, and an image quality is declined.

Japanese Patent Application Laid-open No. 2002-254664 (Pages 2, 4, and 6, and FIG. 3 and FIG. 13), and Japanese Patent Application Laid-open No. H9-187954 disclose that a process called a suction purge are performed periodically in order to prevent these defects. In the process of suction purge, the nozzle group in the nozzle surface is covered by a suction cap which is connected to a negative pressure generating mechanism such as a suction pump, and a negative pressure is generated inside the suction cap by the negative pressure generating mechanism, and impurities in the nozzle are discharged by sucking the ink from each nozzle group. Moreover, the nozzle group of the recording head is covered by a preserving cap, and the nozzle group is preserved for preventing drying of ink and adhering of impurities in the nozzle when not in use. At the same time, the ink is kept moist by the preserving cap.

An outer peripheral lip portion which makes a contact with the nozzle surface to surround an area around the nozzle group is provided to a preserving cap. the outer peripheral lip portion is brought into contact with the nozzle surface, in a state of applying a predetermined load (capping load) to the suction cap and the preserving cap for ensuring an airtightness when covered.

SUMMARY OF THE INVENTION

In recent years, speeding up and achieving high image quality of an ink-jet type image recording apparatus has been facilitated. Therefore, measures such as mounting a multiple number of recording heads, increasing the number of nozzles of each of the recording head, and adding a color of ink have been taken. In a case of adding the color of ink, a nozzle for jetting the added color ink becomes necessary. For coping with the increase in the number of nozzles, a large size suction cap and a preserving cap may be used. Particularly, in such case, it is desirable that an outer peripheral lip portion of the suction cap doesn't collapse inward due to a high negative pressure generated inside the cap when the ink is sucked. Furthermore, it is desirable that the preserving cap is capable of maintaining the airtight state inside the preserving cap over a long period of time without exerting a high capping load on the recording head etc.

An object of the present invention is to provide an ink-jet type image recording apparatus and a purge mechanism which includes a suction cap which is capable of preventing a deformation due to a negative pressure generated inside the cap, and a preserving cap which is capable of maintaining a moisture-retained state of the nozzle group, with a low load exerted on the recording head or the like.

According to a first aspect of the present invention there is provided an ink-jet type image recording apparatus which records an image by jetting an ink onto a medium, the apparatus including:

a recording head having a nozzle surface in which a plurality of nozzles which jets the ink is formed;

a first cap covering the nozzles to prevent the ink inside the nozzles from drying, and including a first lip portion which makes a contact with the nozzle surface when the first cap covers the nozzles;

a second cap covering the nozzle surface and including a second lip portion which makes a contact with the nozzle surface when the second cap covers the nozzles, and which has a stiffness higher than a stiffness of the first lip portion; and a suction mechanism which is connected to the second cap to suck the ink from the nozzles through the second cap.

According to the ink-jet type image recording apparatus of the present invention, since the second lip portion of the second cap (suction cap) has the stiffness higher than the stiffness of the first lip portion of the first cap (preserving cap), the second lip portion of the second cap is hardly deformed, and it is possible to prevent an inward collapse due to the negative pressure which is generated inside the cap at the time of ink suction. Furthermore, it is possible to secure the airtightness of the first cap while absorbing a capping load. Moreover, since there is no inward collapse of the second lip portion of the second cap at the time of sucking the ink, there is no insufficient suction of the ink, and since it is possible to secure the airtightness while reducing the capping load of the preserving cap, at the time of preserving, it is not necessary to increase a stiffness of the recording head, and it is possible to reduce the load exerted on designing.

In the ink-jet type image recording apparatus of the present invention, the nozzles may form a plurality of nozzle groups; and the second cap may include a plurality of second individual caps which correspond to and cover the nozzle groups respectively.

In this case, since the nozzles of the recording head are divided into the nozzle groups, and the second cap includes the second individual caps (individual suction caps) corresponding to the nozzle groups respectively, the ink-jet type image recording apparatus, for example, is capable of sucking the ink independently from each of the nozzle group by dividing the nozzles into nozzle groups according to difference of color of the ink or a difference of whether it is a pigment-based ink or a dye-based ink. In other words, the ink-jet type image recording apparatus of the present invention is capable of sucking the ink independently from the nozzle groups of the recording head.

In the ink-jet type image recording apparatus of the present invention, the second lip portion of the second cap may be thicker than the first lip portion of the first cap, and the second lip portion of the second cap may be formed of a material harder than a material forming the first lip portion of the first cap.

In this case, since the second lip portion of the second cap is thicker than the first lip portion of the first cap, it is possible to realize preventing the inward collapse of the second lip portion of the second cap at the time of suction, and to secure the airtightness while absorbing the capping load at the time of preserving. Moreover, since the second lip portion of the second cap is formed of a material which is harder than (a material of) the first lip portion of the first cap, it is possible to realize preventing the inward collapse etc. of the second lip portion of the second cap at the time of suction, and to secure the airtightness while absorbing the capping load at the time of preserving.

In the ink-jet type image recording apparatus of the present invention, the nozzles may form a plurality of nozzle groups; and the first cap may include a plurality of first individual caps which correspond to and cover the nozzle groups respectively.

In this case, since the first cap includes the first individual caps (individual preserving caps), it is possible to preserve independently the nozzle groups of the recording head by dividing according to the color and drying property of the ink jetted, according to difference of color of the ink or according to a difference of whether it is a pigment-based ink or a dye-based ink. In other words, the ink-jet type image recording apparatus of the present invention is capable of preserving the nozzle groups of the recording head by dividing according to a group of the ink jetted, while reducing the load exerted on the recording head at the time of preserving.

In the ink-jet type image recording apparatus of the present invention, the second cap may be located at a position between the first cap and the recording head when the first cap and the recording head are arranged to face each other, and the first lip portion of the first cap may accommodate the second cap.

In this case, since the first cap and the second cap are almost at an overlapping position, and since each of the suction cap and the preserving cap are capable of cover the nozzle groups of the recording head, it is possible to omit a space in which the second cap is to be arranged, and it is possible to make the apparatus compact.

In the ink-jet type image recording apparatus of the present invention, the nozzles may form a plurality of nozzle groups, and the second cap may include a plurality of second individual caps which correspond to and cover the nozzle groups respectively, and the first lip portion of the first cap may accommodate all the second individual caps.

In this case, since the second cap includes the second individual caps (individual preserving caps), it is possible to preserve independently the nozzle groups of the recording head by dividing according to a difference of color of the ink and/or a difference of whether it is a pigment-based ink or a dye based ink.

In the ink-jet type image recording apparatus of the present invention, the first cap and the second cap may be movable mutually independently, and the second lip portion of the second cap may be movable to a first position at which the second lip portion is located nearer toward the recording head than the first lip portion of the first cap, and the first lip portion of the first cap may be movable to a second position at which the first lip portion is located nearer toward the recording head than the second lip portion of the second cap.

In this case, the second cap is capable of advancing with respect to the recording head more than the first cap, and the first cap is capable of advancing with respect to the recording head more than the second cap, it is possible to carry out each of a suction operation or a preserving operation independently.

In the ink-jet type image recording apparatus of the present invention, the second lip portion of the second cap may be thicker than the first lip portion of the first cap, and the second lip portion of the second cap may be formed of a material harder than a material forming the first lip portion of the first cap.

In this case, since the second lip portion of the second cap is thicker than the first lip portion of the first cap, it is possible to realize preventing the inward collapse of the second lip portion of the second cap at the time of suction, and to secure the airtightness while absorbing the capping load at the time of preserving. Therefore, it is possible to prevent the insufficient suction of the ink, and further to reduce the load exerted on a design of the ink-jet type image recording apparatus. Moreover, since the second lip portion of the second cap is formed of a material which is harder than a material of the first lip portion of the first cap, it is possible to realize preventing the inward collapse of the second lip portion of the second cap at the time of suction, and to secure the airtightness while absorbing the capping load at the time of preserving. Therefore it is possible to prevent the insufficient suction of the ink, and to reduce the load exerted on the design of the ink-jet type image recording apparatus.

The ink-jet type image recording apparatus of the present invention may further include an air discharging mechanism which sucks to discharge an air bubble entered in the recording head; and a switching valve which switchingly connects the suction mechanism to the second cap and the discharge mechanism.

In this case, since the ink-jet type image recording apparatus includes the discharge mechanism, it is possible to remove a bubble of a gas such as air which has accumulated in the ink in the recording head, and to maintain a favorable print quality. Moreover, since the ink-jet type image recording apparatus includes the switching valve, it is possible to use the suction mechanism by switching between the suction cap and the discharge mechanism, and to make the ink-jet type image recording apparatus compact.

In the ink-jet type image recording apparatus of the present invention, a front end of the first lip portion of the first cap may have a tapered shape, and a front end of the second lip portion of the second cap may have the tapered shape. In any of the cases, since the front end of the first lip portion or the second lip portion is tapered shaped, when the first cap or the second cap is pressed against the recording head, the pressing pressure exerted is concentrated at the front end. Therefore, it is possible to decrease the pressing pressure which is required to be exerted at the time of making the first cap or the second cap to make a close contact with the recording head.

In the ink-jet type image recording apparatus of the present invention, a front end of the first lip portion of the first cap and a front end of the second lip portion of the second cap may have tapered shape, and a taper angle of the front end of the first lip portion may be smaller than a taper angle of the front end of the second lip portion.

In this case, since the angle of tapering of the front end of the first lip portion of the first cap is smaller than the angle of tapering of the front end of the front end of the second lip portion of the second cap, the pressing pressure is susceptible to be concentrated on the front end of the first lip portion than the front end of the second lip portion. Therefore, it is possible to make the pressing pressure applied to the preserving cap weaker than the pressing pressure applied to the second cap, and to decrease the load on the printing head when the first cap is being used.

In the ink-jet type image recording apparatus of the present invention, the first cap and the second cap may be formed of a rubber material selected from a group consisting of natural rubber, isoprene rubber, styrene butadiene rubber, butadiene rubber, chloroprene rubber, nitrile rubber, butyl rubber, ethylene propylene rubber, urethane rubber, silicone rubber, acrylic rubber, chlorosulfonated polyethylene rubber, fluororubber, and hydrogenated nitrile. In this case, it is possible to form the first cap and the second cap having a moderate hardness.

According to the second aspect of the present invention, there is provided a purge mechanism which purge a recording head having a nozzle surface in which a plurality of nozzles for jetting an ink are formed, the purge mechanism including:

a first cap covering the nozzles to prevent the ink inside the nozzles from drying, and including a first lip portion which makes a contact with the nozzle surface when the first cap covers the nozzles;

a second cap covering the nozzles and including a second lip portion which makes a contact with the nozzle surface when the second cap covers the nozzles, and which has a stiffness higher than a stiffness of the first lip portion; and a suction mechanism being connected to the second cap to suck the ink from the nozzles through the second cap.

According to the purge mechanism of the present invention, since the second lip portion of the second cap has the stiffness higher than the stiffness of the first lip portion of the first cap, the second lip portion of the second cap is hardly deformed, and it is possible to prevent an inward collapse due to the negative pressure which is generated inside the cap at the time of ink suction. Furthermore, it is possible to secure the airtightness of the first cap while absorbing a capping load. Moreover, since there is no inward collapse of the second lip portion of the second cap at the time of sucking the ink, there is no insufficient suction of the ink, and since it is possible to secure the airtightness while reducing the capping load of the preserving cap, at the time of preserving, it is not necessary to increase a stiffness of the recording head, and it is possible to reduce the load exerted on designing.

DETAILED DESCRIPTION OF THE PREFERRED EMBODIMENTS

Figure 1:
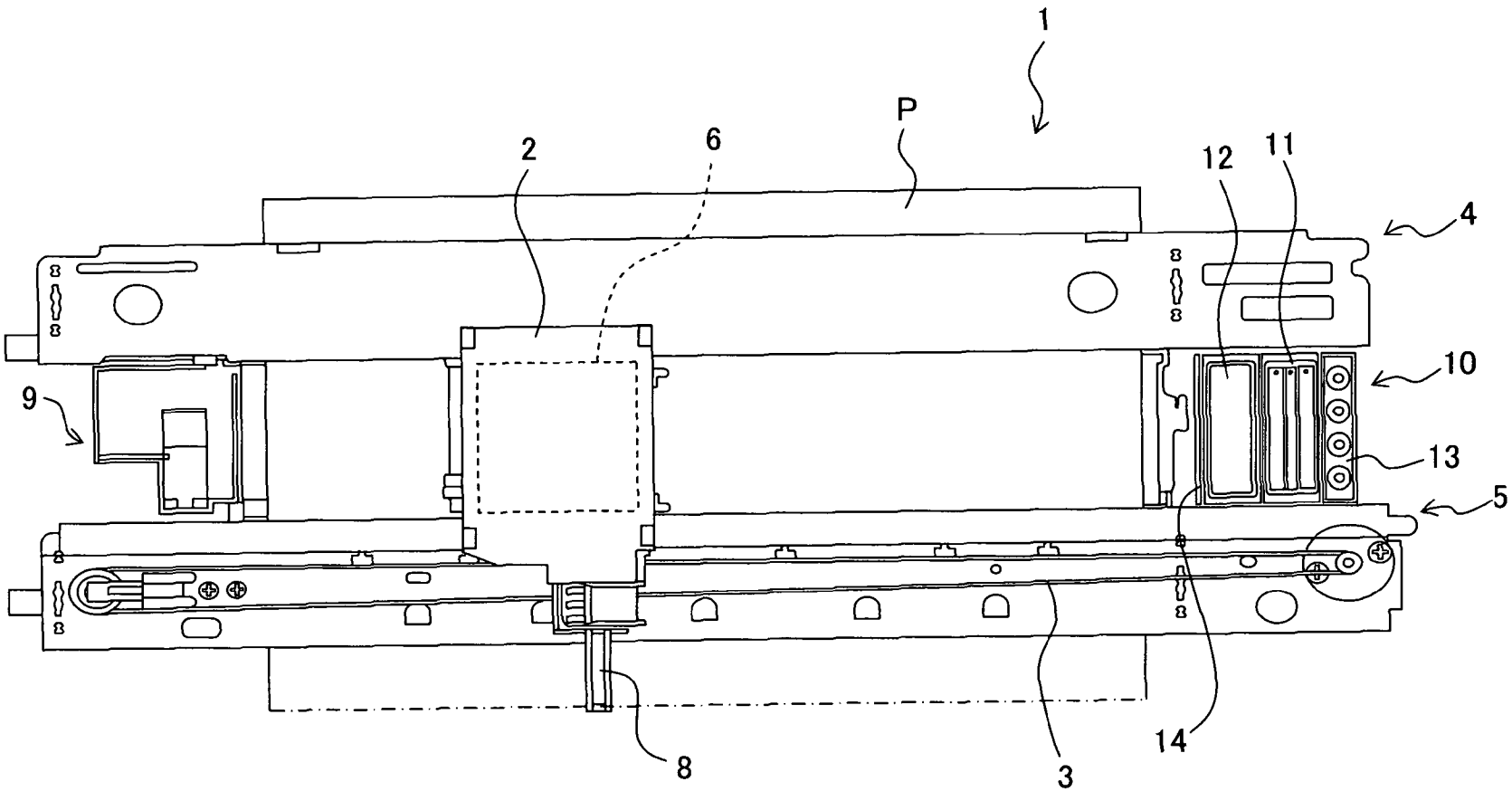
FIG. 1 is an embodiment of an ink-jet type image recording apparatus according to the present invention, and is a schematic plan view showing a portion which carries out recording.

An embodiment of an ink-jet type image recording apparatus according to the present invention will be described below with reference to the accompanying figures. FIG. 1 shows a schematic plan view showing a portion of an ink-jet type image recording apparatus (ink-jet printer) 1, which carries out recording. The ink-jet printer 1 includes a head holder 2 which functions as a carriage which reciprocates in a left and right direction (main scanning direction) in FIG. 1, an endless belt 3 which drives the head holder 2, and a pair of guide members 4 and 5 which are arranged to be separated in a direction of feeding of a recording paper P (secondary scanning direction), both extended in the main scanning direction.

Figure 2:
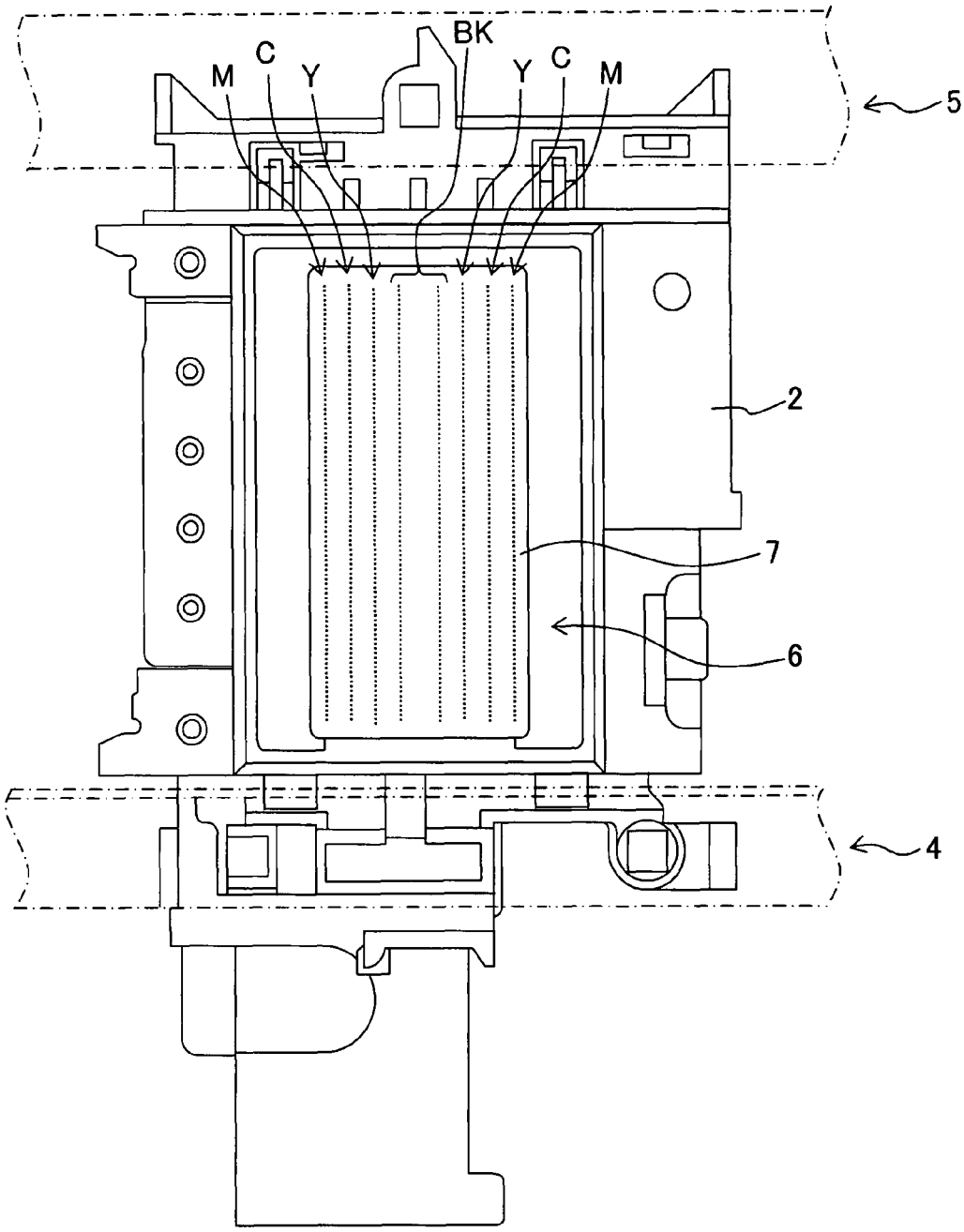
FIG. 2 is a bottom view of a head holder of the ink-jet type image recording apparatus.

As shown in FIG. 2, a recording head 6 is provided on a surface of the head holder 2 facing the recording paper P, and a nozzle surface 7 is formed on a surface of the recording head 6 facing the recording paper P. A plurality of nozzle groups is arranged in the nozzle surface 7 in the main scanning direction at a predetermined interval. In each of the nozzle groups, a plurality of nozzles is arranged in a straight line. In other words, each of the nozzle groups forms a nozzle row in which the nozzles are arranged in a row. Two nozzle rows in the middle area nozzle group BK for a black ink, and nozzle rows arranged on both sides thereof are nozzle group Y for a yellow ink, a nozzle group C for a cyan ink, and a nozzle group M for a magenta ink, in an order from an inner side. A tube 8 is used for supplying ink from an ink tank (not shown in the diagram) which is provided separately to the head holder 2.

This ink-jet printer 1 carries out printing on the recording paper by jetting inks from the nozzle groups BK, C, Y, and M of the recording head 6, while moving the recording paper P in the secondary scanning direction, and reciprocating the head holder 2 in the main scanning direction.

A flushing station 9, which receives the ink jetted from the nozzle groups BK, C, Y, and M of the recording head 6 irrespective of whether or not the recording is carried out, is arranged on a portion of the ink-jet printer 1 facing the recording head 6 when the recording head 6 is moved to one end in the main scanning direction. It is possible to discharge ink which is thickened inside an ink channel formed in the recording head 6, and/or an air bubble which is generated inside the ink channel by jetting the ink irrespective of whether or not the recording is carried out. In this manner, it is possible to prevent and eliminate clogging of the nozzles, and to facilitate maintenance and recovery of a jetting function of the nozzle groups BK, C, Y, and M by jetting (flushing) the ink to the flushing station 9.

A purge station 10 which sucks the ink from the nozzle groups BK, C, Y, and M of the recording head 6, is arranged on a portion of the ink-jet printer 1, facing the recording head 6 when the recording head 6 is moved to the other end in the main scanning direction. The ink is sucked from the nozzle groups BK, C, Y, and M of the recording head 6 by a manual command (switch operation or the like) by a user, and/or an automatic command from a control section 115 which will be described later. By such suction, it is possible to discharge the ink which is thickened inside the ink channel, and/or an air bubble which is generated inside the ink channel, and to recover the jetting function of the nozzle groups BK, C, Y, and M.

The purge station 10 includes a suction cap (second cap) 11, a preserving cap (first cap) 12, an air discharge (air exhaust) cap 13, a wiper blade 14, a drive unit 23, and a suction pump (suction mechanism) 24. The suction cap 11 covers the nozzle groups BK, C, Y, and M when the ink is sucked from the nozzle groups BK, C, Y, and M of the recording head 6. The preserving cap 12 prevents drying of ink inside the nozzles by covering the nozzle groups BK, C, Y, and M of the recording head 6, when the recording head 6 is not used. The air discharge cap 13 carries out an air discharge of a buffer tank which is provided to the head holder 2 and will be described later. The wiper blade 14 wipes the ink or the like adhered to the nozzle surface 7 of the recording head 6. The drive unit 23 drives each of the caps 11 to 13 toward the head holder 6. The suction pump (suction mechanism) 24 generates a suction force in the suction cap 11 and the air discharge cap 13.

Figure 3:
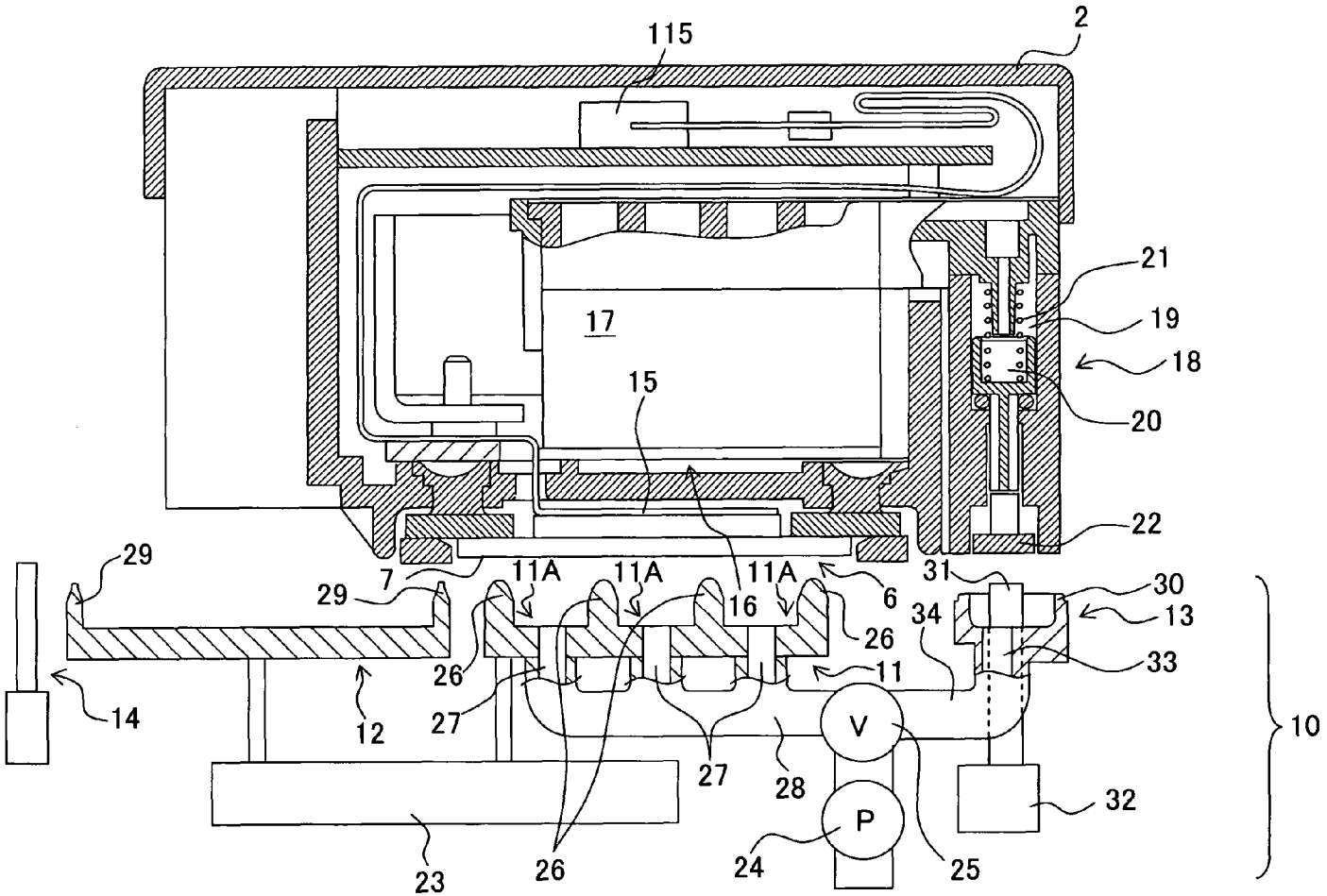
FIG. 3 is a side cross-sectional view of a head holder, and a schematic view of a purge station, of the ink-jet type image recording apparatus of the present invention.

Next, a structure of the head holder 2 will be described below with reference to a side cross-sectional view of the head holder 2 in FIG. 3. A surface (surface on a lower side in FIG. 3) of the recording head 6 which is provided to the head holder 2 is the nozzle surface 7. A wire member (wiring member) 15 is fixed to another surface of the head holder 2 on a side opposite to the nozzle surface 7. One end of the wire member 15 is connected to the control section 115. A signal for jetting the ink is applied from the control section 115 to the recording head 6 via the wire member 15. Moreover, a buffer tank 16 is provided at an upper side of the recording head 6. The ink is supplied to the buffer tank 16 from an ink tank which is provided separately and not shown in the diagram. A plurality of storage chambers 17 are formed inside the buffer tank 16, and the ink supplied to the buffer tank 16 is supplied to the recording head 6 upon being stored temporarily in the storage chambers 17 provided according to the types of ink respectively.

An air discharge mechanism 18 which discharges air inside the buffer tank 16 is provided on a side surface of the head holder 2. This air discharge mechanism 18 includes a plurality of air discharge channels 19 which communicate with the storage chambers 17 of the buffer tank 16 respectively. A lower end of each air discharge channel 19 opens to an outside of the recording head 6 on almost the same plane as the nozzle surface 7 of the recording head 6. An air discharge valve 20 is provided in each of the air discharge channels 19. Each of the air discharge valves 20 are biased by a spring 21 toward an end opening to an outside of the air discharge channel 19 normally, and each of the storage chambers 17 is cut off from an outside air. An operating pin 22 is connected to each of the air discharge valves 20, and it is possible to open the air discharge valve 20 and to let each storage chamber 17 of the buffer tank 16 to have a through pass with the external air by pushing an end portion of the operating pin 22, which is exposed from the external opening end of each air discharge channel 19, into the air discharge channel 19.

The drive unit 23 is capable of driving the suction cap 11 and the air discharge cap 13 simultaneously, and driving the preserving cap 12 and the other two caps 11 and 13 independently. The suction cap 11 and the air discharge cap 13 communicate selectively with the suction pump 24 by a switching valve 25. In other words, it is possible to select as to in which of the suction cap 11 or the air discharge cap 13 the suction force is to be generated.

Figure 4A:
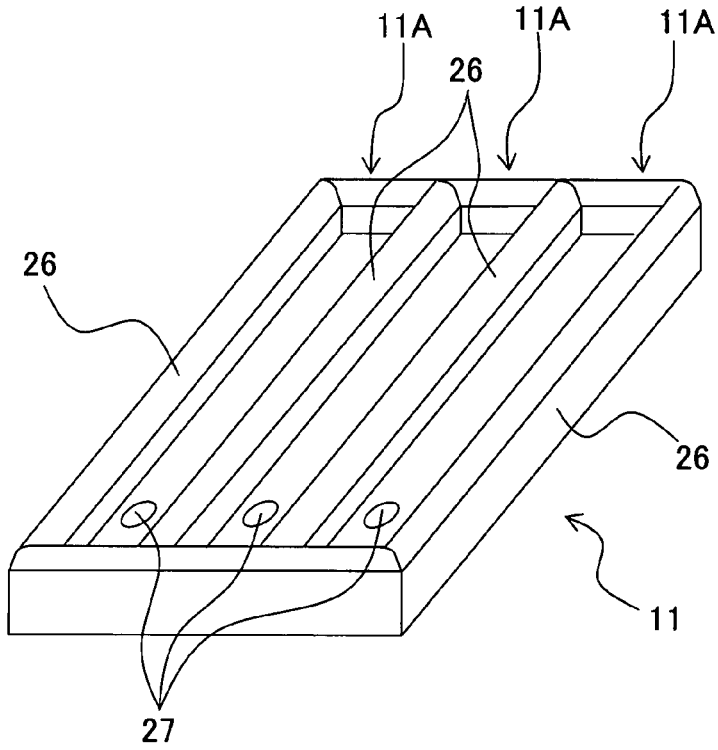
FIG. 4A is a perspective view of a suction cap.

As shown in FIG. 4A, the suction cap 11 (hereinafter called as 'integrated suction cap 11') is formed integrally in the form of three suction caps (individual suction caps, second individual caps) 11A arranged side by side in a line. An outer peripheral lip portion (second lip portion) 26 is provided around each of the suction caps 11A, and is formed to be box shaped with an upper surface open. The adjacent suction caps 11A are partitioned by the outer peripheral lip portion 26 positioned between the adjacent suction caps 11A. A suction port 27 is provided on a bottom wall portion of each of the suction cap 11A, and each of the suction ports 27 is connected to a suction tube 28 which is common. This suction tube 28 is connected to the suction pump 24 via the switching valve 25.

The integrated suction cap 11 which includes these three suction caps 11A is formed to be integrated by an elastic material such as a hard rubber having a hardness of about 50°, and the outer peripheral lip portion 26 is formed such that the thickness of the outer peripheral lip portion 26 (a thickness in a direction parallel to the nozzle surface 7) has a stiffness such that it does not collapse due to a negative pressure generated inside the suction cap. Moreover, a front end portion of the outer peripheral lip portion has a tapered shape, and the front end of the outer peripheral lip portion is rounded. Each of the suction caps 11A of this integrated suction cap 11 is arranged in a row in a direction of arrangement of the nozzle groups BK, C, Y, and M of the recording head 6.

Figure 4B:
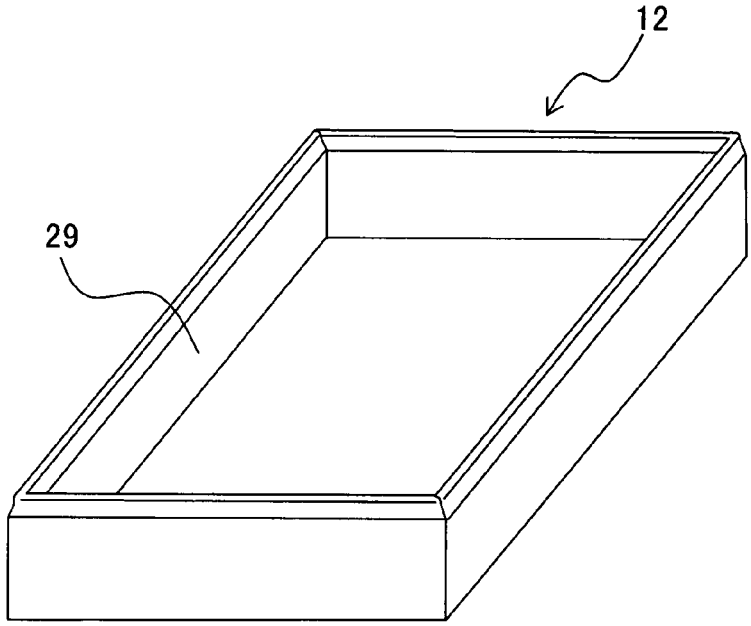
FIG. 4B is a perspective view of a preserving cap.

As it is shown in FIG. 4B, an outer peripheral lip portion (first lip portion) 29 is provided around the preserving cap 12, and is formed to be box shaped with an upper surface open. The preserving cap 12 is capable of covering collectively all the nozzle groups BK, C, Y, and M of the recording head 6. This preserving cap 12 is formed of an elastic material such as a soft rubber having a hardness of about 30°. The outer peripheral lip portion 29 is thinner than the outer peripheral lip portion 26 of the integrated suction cap 11. Moreover, at a front end of the outer peripheral lip portion 29, a tapered portion having an angle more acute than an angle of the tapered portion of the suction cap 11 is formed. In other words, a small projection (protrusion) is formed at the front end of the outer peripheral portion 29 of the suction cap 11. No openings are formed in a bottom wall portion and the outer peripheral lip portion 29 of the preserving cap 12, and when the preserving cap 12 makes a close contact with the nozzle surface 7 of the recording head 6, a closed space is formed inside the preserving cap 12.

The air discharge cap 13 is formed of an elastic material such as a rubber, to be box shaped with an outer surface open. An outer peripheral wall portion 30 of the air discharge cap 13 is capable of covering collectively an external opening end of each of the air discharge channels 19. A plurality of release rods 31 which are pierced through the air discharge cap 13 is arranged to be vertically movable, on a bottom wall portion of the air discharge valve 13, at a position facing each of the operating pins 22. Each of the release rods 31 is driven by a drive unit 32. The drive unit 32 is capable of pressing the release rod 31 into the operating pin 22 and pushing up the operating pin 22 against the spring so as to open the air discharge valve 20. Moreover, it is possible to close the air discharge valve 20 by isolating the release rod 31 from the operating pin 22. Furthermore, a suction port 33 is formed in the bottom wall portion of the air discharge cap 13, and the suction port 33 and the suction pump 24 are connected by a suction tube 34 via the switching valve 25.

Next, a case of sucking the ink from the nozzle groups BK, C, Y, and M, and a case of preserving the nozzle groups BK, C, Y, and M will be described below.

Firstly, in the case of sucking the ink from the nozzle groups BK, C, Y, and M, the head holder 2 is moved to a position facing the purge station 10 so as to make the nozzle surface 7 of the recording head 6 face the integrated suction cap 11. Moreover, the integrated suction cap 11 and the air discharge cap 13 are moved toward the head holder 2 by the drive unit 23, and all the nozzle groups BK, C, Y, and M provided in the nozzle surface 7 of the recording head are covered by the integrated suction cap 11, and the external opening end of each of the air discharge channel 19 of the air discharge mechanism 18 is covered by the air discharge cap 13.

Figure 5A:
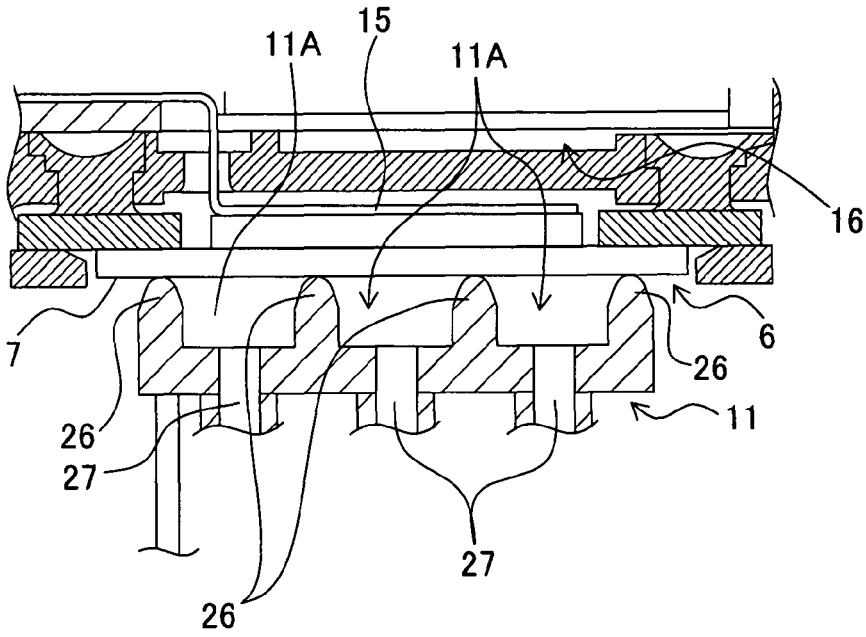
FIG. 5A is a schematic view showing a state of a nozzle group covered by the suction cap.

At this time, as shown in FIG. 5A, a front end of the outer peripheral lip portion of each of the suction cap 11A formed in the integrated suction cap 11 covering the nozzle groups BK, C, Y, and M makes a contact with the nozzle surface 7 of the recording head 6. Here, the two rows of nozzle groups for the black ink are covered by the suction cap 11A at the center, and the three nozzle groups C, Y, and M which are arranged on each of both sides of the nozzle group BK are covered by the suction caps 11A.

Furthermore, the suction pump 24 is driven after switching the switching valve 25 to a side of the integrated suction cap 11, and the air in a space inside each of the suction caps 11A is sucked. At this time, the space inside each of the suction cap 11 is negatively pressurized, and the ink is sucked from each of the nozzle groups BK, C, Y, and M covered by each of the suction caps 11A. At this time, since the black ink and the color inks of other three colors are covered by different suction caps 11A, it is possible to avoid a defect due to entering of the black ink (a high-density mixed-color ink) into the nozzle groups Y, C, and M for the color inks. Particularly, when the black ink is a pigment-based ink and the other three color inks are dye-based inks, and these inks are mixed, there is a possibility of an occurrence of clogging the nozzles by agglutination. However, since the inks are sucked separately as described above, there is no such possibility.

The negative pressure generated in the space inside each of the suction cap 11A is substantial, and a load (force of attraction) which acts in a direction of making collapse the outer peripheral lip portion 26 inward is exerted on the outer peripheral lip portion 26. However, since the outer peripheral lip portion 26 is formed of a hard elastic material, and has a sufficient thickness, and has a shape which allows it to be deformed hardly by making gentle the taper of the front end portion of the outer peripheral lip portion 26, it is possible to improve (increase) the stiffness of the outer peripheral lip portion 26. Since the outer peripheral lip portion 26 does not collapse inward because of the high stiffness, it is possible to suck the ink stably.

Moreover, the release rod 31 is driven by the drive unit 32 with the external opening end of each air discharge channel 19 covered by the air discharge cap 13. It is possible to suck the air accumulated inside the storage chamber 17 of the buffer tank 16 when the air discharge valve 20 is opened by pushing the operating pin 22 of the air discharge mechanism 18, and the suction pump 24 is driven after switching the switching valve 25 to the side of the air discharge cap 13. Here, the air inside the storage chamber 17 is considered to be accumulated because an air bubble, which is generated in the ink supplied to the buffer tank 16 from the ink tank via the tube, is separated in the buffer tank 16.

After the suction of the ink from the nozzle groups BK, C, Y, and M in such manner, and the suction of the unnecessary air from the buffer tank 16, the drive unit 23 is driven), and the suction cap 11 and the air discharge cap 13 are returned to a stand-by position. The suction of the ink and the suction of the air are not restricted to be carried out simultaneously, and only the suction of the ink from each of the nozzle groups BK, C, Y, and M may be carried out and only the suction of the air from the buffer tank 16 may be carried out.

Figure 5B:
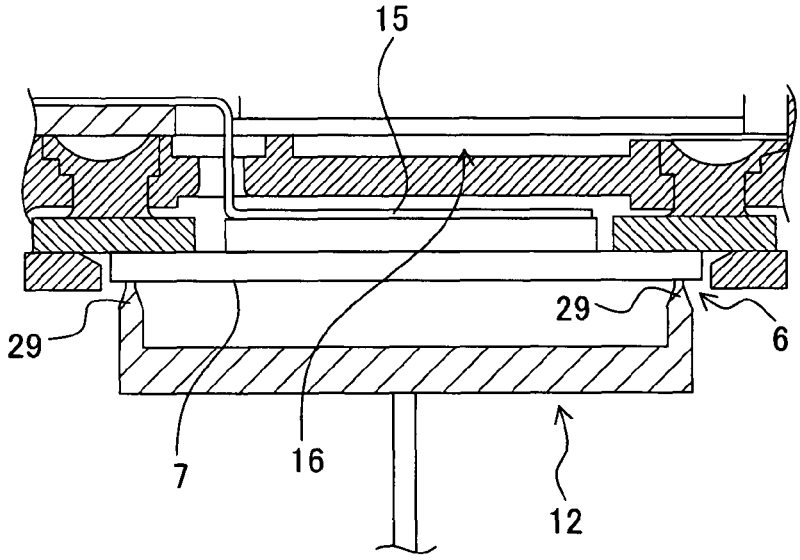
FIG. 5B is a schematic view showing a state of a nozzle group covered by the preserving cap.

On the other hand, in a case of preserving the nozzle groups BK, C, Y, and M, firstly, the head holder 2 is moved to a position facing the purge station 10 so as to make the nozzle surface 7 of the recording head 6 face the preserving cap 12. Further, the preserving cap is allowed to make a contact with the head holder 2 by the drive unit 23, and all the nozzle groups BK, C, Y, and M on the nozzle surface 7 are covered by the preserving cap 12 (FIG. 5B). At this time, the front end of the outer peripheral lip portion 29 of the preserving cap 12 is in contact with the nozzle surface 7. Here, the stiffness of the outer peripheral lip portion is low, because the outer peripheral lip portion 29 is formed of a soft elastic material, the outer peripheral lip portion 29 is thin, the front end portion of the outer peripheral lip portion 29 is thin, and has a shape susceptible to be deformed. Therefore, the front end of the outer peripheral lip portion 29 makes a firm close contact with the nozzle surface. Accordingly, the airtightness in the space inside the preserving cap 12 is improved. The cap load is susceptible to be absorbed and the load exerted on the recording head 6 is reduced because the stiffness of the outer peripheral lip portion 29 is low. The nozzle groups BK, C, Y, and M of the recording head preserved in such manner has a favorable ink-moisture retaining property, and clogging due to the thickening of ink is prevented.

It is possible to form the suction cap of which only the outer peripheral lip portion is made of a hard elastic material. Similarly, it is also possible to form the preserving cap of which only the outer peripheral lip portion is made of a soft elastic material. Moreover, it is possible to realize an improvement in the stiffness of the outer peripheral lip portion of the suction cap to be higher than the stiffness of the outer peripheral lip portion of the preserving cap, by making the outer peripheral lip portion of the suction cap thicker than the outer peripheral lip portion of the preserving cap, by forming the outer peripheral lip portion of the suction cap of a material harder than (a material of) the outer peripheral lip portion of the preserving cap, or by making the outer peripheral lip portion of the suction cap to be hardly deformable than the outer peripheral lip portion of the preserving cap. Or, it can be realized by an arbitrary combination of the measures mentioned above.

Figure 6A:
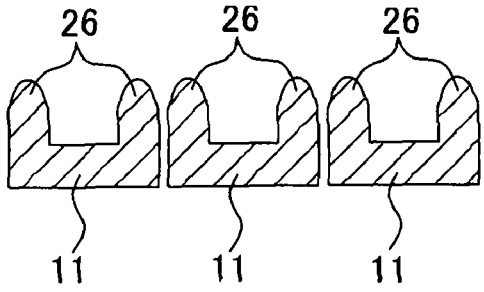
FIG. 6A to FIG. 6D are side cross-sectional views of a cap showing each of modified embodiments of the suction cap and the preserving cap.
Figure 6B:
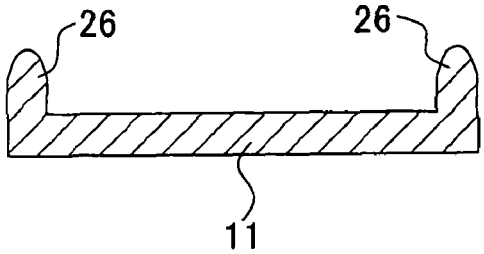
Figure 6C:
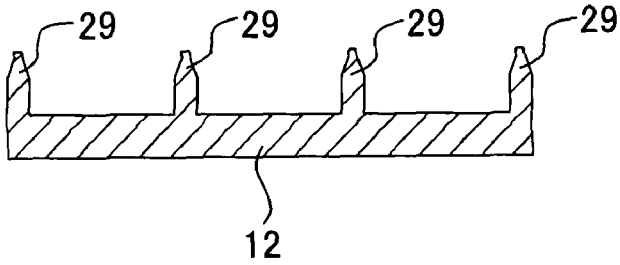
Figure 6D:
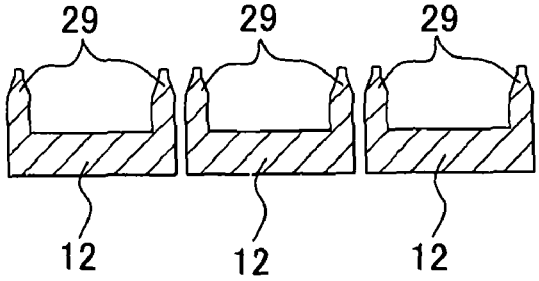

As shown in FIG. 6A, it is also possible to provide the plurality of suction caps (individual suction caps) 11 separately, and as shown in FIG. 6B, it is also possible to suck the ink from each of the nozzle groups upon covering all the nozzle groups on the nozzle surface by one suction cap 11. It is also possible to preserve the nozzle groups according to the group, by providing the plurality of preserving caps 12. When the plurality of preserving caps 12 is provided, the preserving caps may be formed to be integrated as shown in FIG. 6C, or the preserving caps may be provided separately as shown in FIG. 6D. Moreover, it is also possible to divide the nozzle groups into groups according to the drying property of the ink, and to set the material and the stiffness of the preserving caps according to these groups.

Figure 7A:
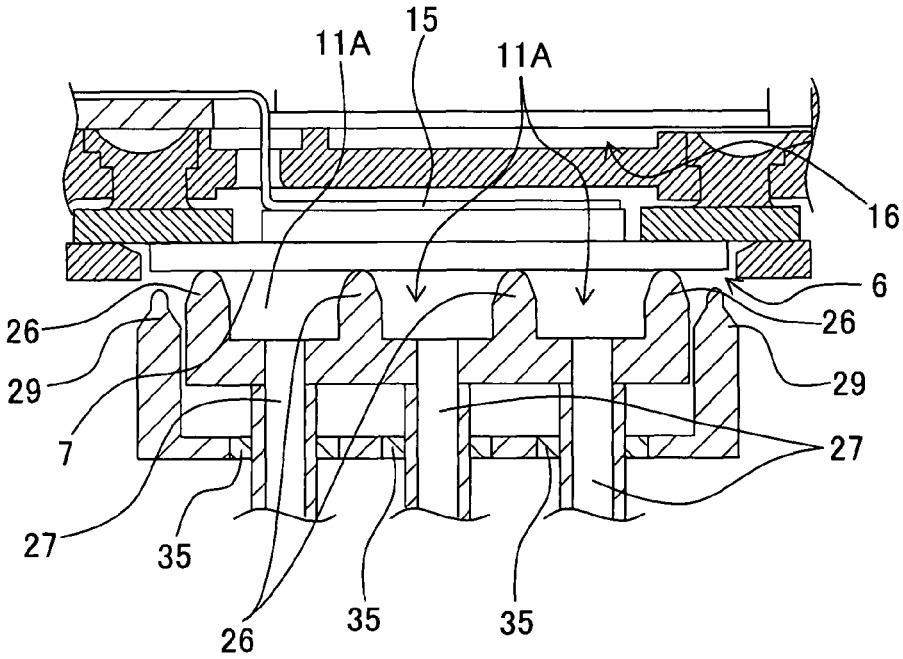
FIG. 7A is a modified embodiment of the suction cap, and is a schematic diagram showing a state of a nozzle group covered by the suction cap.
Figure 7B:
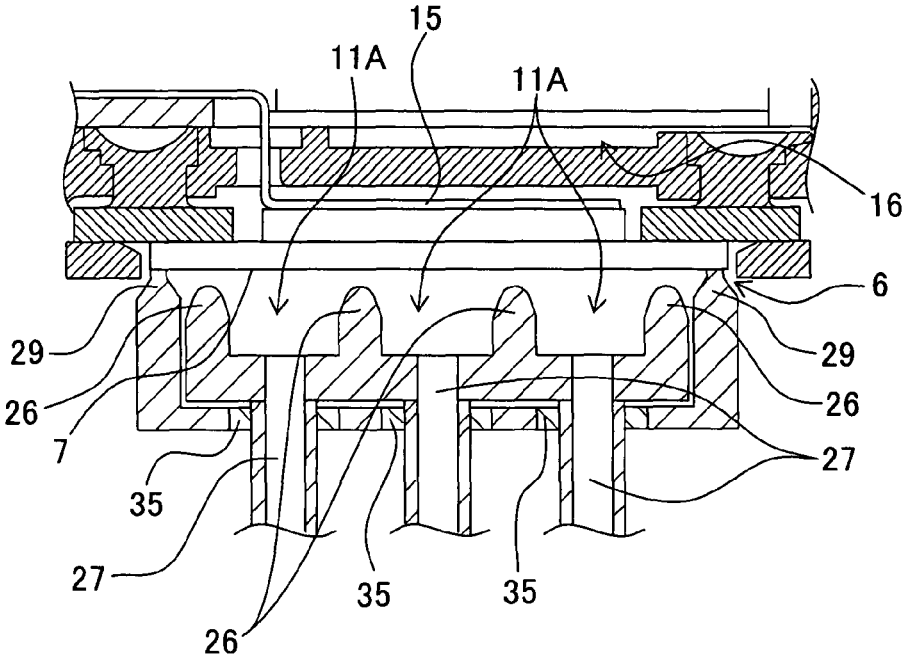
FIG. 7B is a modified embodiment of the preserving cap, and is a schematic diagram showing a state of a nozzle group covered by the preserving cap.

As shown in FIG. 7A and FIG. 7B, it is also possible to form the outer peripheral lip portion 29 of the preserving cap 12 of a size which is capable of accommodating the suction cap 11, and to be higher than the outer peripheral lip portion of the suction cap 11 which is accommodated. In this case, when the recording head 6 and the preserving cap 12 are made to face mutually, it is possible to arrange the suction cap 11 such that the suction cap 11 is positioned between the preserving cap 12 and the recording head 6, and to move the suction cap 11 and the preserving cap 12 independently toward the recording head 6 by the drive unit 23.

In a case of sucking the ink, as shown in FIG. 7A, the suction cap 11 which is accommodated inside the preserving cap 12 is moved toward the recording head 6, and the nozzle groups BK, C, Y, and M of the nozzle surface 7 are covered with the outer peripheral lip portion 26 of the suction cap 11 is a state projected more than the outer peripheral lip portion 29 of the preserving cap 12, toward the recording head 6. Moreover, at the time of preserving the nozzle groups BK, C, Y, and M, as shown in FIG. 7B, the preserving cap 12 is made to advance toward the recording head 6 with the suction cap 11 accommodated inside the preserving cap 12, the outer peripheral lip portion 29 of the preserving cap 12 is made to be projected more than the outer peripheral lip portion 26 of the suction cap, and brought into contact with the nozzle surface 7, and the nozzle groups BK, C, Y, and M are covered. A seal member (sealing member) 35 in FIG. 7A and FIG. 7B, secures the airtightness at the time of preserving. Moreover, at the time of preserving, the suction port 27 of the suction cap is cut-off from the outside by switching to the switching valve 25 or the suction pump 24.

Figure 8:
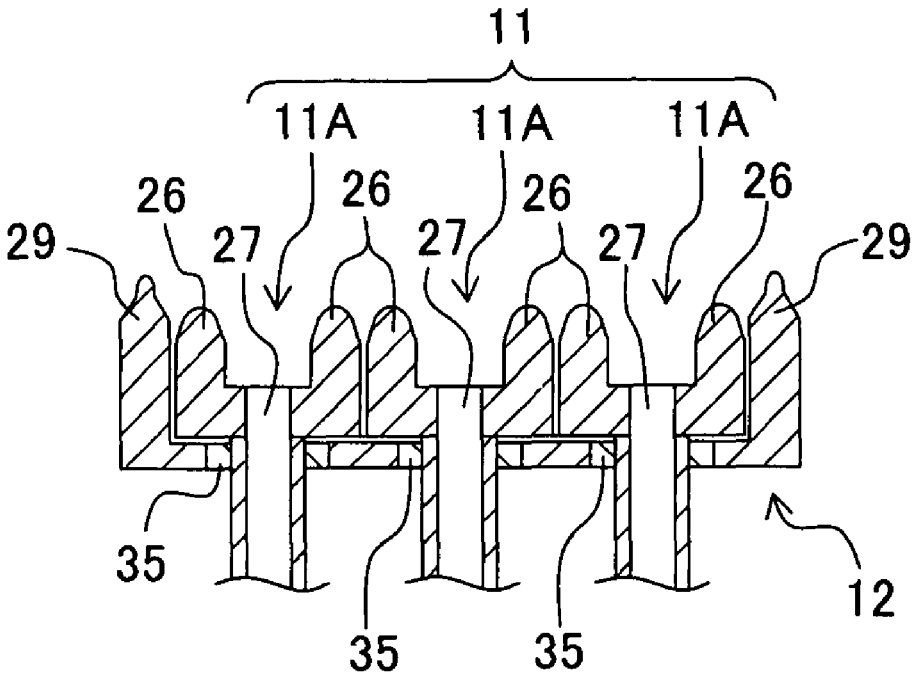
FIG. 8 is a side cross-sectional view showing a modified embodiment of the suction cap and the preserving cap.

When the suction cap 11 is formed to be accommodated inside the preserving cap in such manner, all the nozzle groups may be covered by one suction cap. As shown in FIG. 8, a plurality of suction caps 11A may be provided, and all the suction caps 11A may be accommodated in the preserving cap 12. Or, the preserving cap 12 may be provided for each suction cap 11A.

The suction cap 11, the preserving cap 12, and the air discharge cap 13 may be formed of an arbitrary elastic material. For example, it is possible to use a rubber material such as natural rubber, isoprene rubber, styrene butadiene rubber, butadiene rubber, chloroprene rubber, nitrile rubber, butyl rubber, ethylene propylene rubber, urethane rubber, silicone rubber, acrylic rubber, chlorosulfonated polyethylene rubber, fluororubber, and hydrogenated nitrile rubber.

The number of nozzle groups is not restricted to the number in an example in the embodiment described above, and may be arbitrary. In accordance with the number of nozzle groups, the number of individually formed individual suction caps, individual preserving caps, and individual air discharge caps may be arbitrary. Moreover, it is possible to use an arbitrary pump provided that it is possible to generate the desired suction force. A pump such as a tube pump for example, may be used. In the embodiment described above, the ink-jet recording apparatus and the purge mechanism include the discharging cap, the wiper blade 14 and the drive unit. However, these are arbitrary components and there is no need to be included in the ink-jet recording apparatus and the purge mechanism.

What is claimed is:

1. An ink-jet type image recording apparatus which records an image by jetting an ink onto a medium, the apparatus comprising:

a recording head having a nozzle surface in which a plurality of nozzles which jets the ink is formed;

a first cap covering the nozzles to prevent the ink inside the nozzles from drying, and including a first lip portion which makes a contact with the nozzle surface when the first cap covers the nozzles;

a second cap covering the nozzle surface and including a second lip portion which makes a contact with the nozzle surface when the second cap covers the nozzles, and which has a stiffness higher than a stiffness of the first lip portion; and a suction mechanism which is connected to the second cap to suck the ink from the nozzles through the second cap.

2. The ink-jet type image recording apparatus according to claim 1;

wherein the nozzles form a plurality of nozzle groups; and wherein the second cap includes a plurality of second individual caps which correspond to and cover the nozzle groups respectively.

3. The ink-jet type image recording apparatus according to claim 1;

wherein the second lip portion of the second cap is thicker than the first lip portion of the first cap.

4. The ink-jet type image recording apparatus according to claim 1;

wherein the second lip portion of the second cap is formed of a material harder than a material forming the first lip portion of the first cap.

5. The ink-jet type image recording apparatus according to claim 1;

wherein the nozzles form a plurality of nozzle groups; and wherein the first cap includes a plurality of first individual caps which correspond to and cover the nozzle groups respectively.

6. The ink-jet type image recording apparatus according to claim 1;

wherein the second cap is located at a position between the first cap and the recording head when the first cap and the recording head are arranged to face each other, and the first lip portion of the first cap accommodates the second cap.

7. The ink-jet type image recording apparatus according to claim 6;

wherein the nozzles form a plurality of nozzle groups;

wherein the second cap includes a plurality of second individual caps which correspond to and cover the nozzle groups respectively; and wherein the first lip portion of the first cap accommodates all the second individual caps.

8. The ink-jet type image recording apparatus according to claim 6;

wherein the first cap and the second cap are movable mutually independently, and the second lip portion of the second cap is movable to a first position at which the second lip portion is located nearer toward the recording head than the first lip portion of the first cap, and the first lip portion of the first cap is movable to a second position at which the first lip portion is located nearer toward the recording head than the second lip portion of the second cap.

9. The ink-jet type image recording apparatus according to claim 6;

wherein the second lip portion of the second cap is thicker than the first lip portion of the first cap.

10. The ink-jet type image recording apparatus according to claim 6;

wherein the second lip portion of the second cap is formed of a material harder than a material forming the first lip portion of the first cap.

11. The ink-jet type image recording apparatus according to claim 1, further comprising:

an air discharging mechanism which sucks to discharge an air bubble entered in the recording head; and a switching valve which switchingly connects the suction mechanism to the second cap and the discharge mechanism.

12. The ink-jet type image recording apparatus according to claim 1;

wherein a front end of the first lip portion of the first cap has a tapered shape.

13. The ink-jet type image recording apparatus according to claim 1;

wherein a front end of the second lip portion of the second cap has a tapered shape.

14. The ink-jet type image recording apparatus according to claim 1;

wherein a front end of the first lip portion of the first cap and a front end of the second lip portion of the second cap have tapered shape, and a taper angle of the front end of the first lip portion is smaller than a taper angle of the front end of the second lip portion.

15. The ink-jet type image recording apparatus according to claim 1;

wherein the first cap and the second cap are formed of a rubber material selected from a group consisting of natural rubber, isoprene rubber, styrene butadiene rubber, butadiene rubber, chloroprene rubber, nitrile rubber, butyl rubber, ethylene propylene rubber, urethane rubber, silicone rubber, acrylic rubber, chlorosulfonated polyethylene rubber, fluororubber, and hydrogenated nitrile.

16. The ink-jet type image recording apparatus according claim 1;

wherein a front end of the first lip portion is rounded and a small projection is formed at a front end of the second lip portion.

17. A purge mechanism which purge a recording head having a nozzle surface in which a plurality of nozzles which jets an ink are formed, the purge mechanism comprising:

a first cap covering the nozzles to prevent the ink inside the nozzles from drying, and including a first lip portion which makes a contact with the nozzle surface when the first cap covers the nozzles;

a second cap covering the nozzles and including a second lip portion which makes a contact with the nozzle surface when the second cap covers the nozzles, and which has a stiffness higher than a stiffness of the first lip portion; and a suction mechanism being connected to the second cap to suck the ink from the nozzles through the second cap.

18. The purge mechanism according to claim 17;

wherein the nozzles form a plurality of nozzle groups; and wherein the second cap includes a plurality of second individual caps which correspond to and cover the nozzle groups respectively.

19. The purge mechanism according to claim 17;

wherein the second lip portion of the second cap is thicker than the first lip portion of the first cap.

20. The purge mechanism according to claim 17;

wherein the second lip portion of the second cap is formed of a material which is harder than a material forming the first lip portion of the first cap.

21. The purge mechanism according to claim 17;

wherein the second cap is located at a position between the first cap and the recording head when the first cap and the recording head are arranged to face each other, and the first lip portion of the first cap accommodates the second cap.

22. The purge mechanism according to claim 17;

wherein a front end of the first lip portion is rounded and a small projection is formed at a front end of the second lip portion.

* * * * *